US005209191A

United States Patent [19]

Kopec

[11] Patent Number: 5,209,191

[45] Date of Patent: May 11, 1993

[54] AIR INTAKE MANIFOLD FOR AN INTERNAL COMBUSTION ENGINE

[75] Inventor: Eduard Kopec, Bietigheim-Bissingen, Fed. Rep. of Germany

[73] Assignee: Filterwerk Mann & Hummel GmbH, Ludwigsburg, Fed. Rep. of Germany

[21] Appl. No.: 800,361

[22] Filed: Dec. 3, 1991

[30] Foreign Application Priority Data

Dec. 3, 1990 [DE] Fed. Rep. of Germany ..... 4038509

[51] Int. Cl.[5] ..... F02M 35/10

[52] U.S. Cl. ..... 123/52 MC; 123/572

[58] Field of Search ..... 123/572, 52 M, 52 MV, 123/52 MB, 52 MC

[56] References Cited

U.S. PATENT DOCUMENTS

| | | | |
|---|---|---|---|
| 3,505,983 | 4/1970 | Hartel | 123/52 MB |
| 4,262,639 | 4/1981 | Motosugi et al. | 123/52 MB |
| 4,715,329 | 12/1987 | Yasuda et al. | 123/572 |
| 4,811,697 | 3/1989 | Kurahashi | 123/572 |
| 4,862,860 | 9/1989 | Shinohara | 123/572 |
| 4,947,812 | 8/1990 | Inoue et al. | 123/572 |
| 4,958,613 | 9/1990 | Hiraoka et al. | 123/572 |
| 4,981,115 | 1/1991 | Okasako et al. | 123/52 MV |
| 5,014,654 | 5/1991 | Iashibashi | 123/52 MC |

FOREIGN PATENT DOCUMENTS

| | | | |
|---|---|---|---|
| 251159 | 1/1988 | European Pat. Off. . | |
| 2822409 | 6/1984 | Fed. Rep. of Germany . | |
| 0075531 | 6/1980 | Japan | 123/52 MB |
| 2-37104 | 2/1990 | Japan . | |
| 1601817 | 11/1981 | United Kingdom . | |

*Primary Examiner*—David A. Okonsky
*Attorney, Agent, or Firm*—Foley & Lardner

[57] ABSTRACT

An air intake manifold for an internal combustion engine including a mounting flange through which a plurality of intake ducts open. Blow-by gases from the crankcase of the engine are introduced into the intake ducts through channels or passageways communicating with the ducts adjacent a face of the mounting flange which is fastened to the cylinder head of the engine. Connecting means also are provided through which the blow-by gases are introduced into the channels or passageways. The invention provides a simple design for feeding blow-by gases into the air intake manifold and for assuring uniform filling of the individual intake ducts with blow-by gases which lubricate the intake valves due to their slight oil content.

6 Claims, 4 Drawing Sheets

AIR INTAKE MANIFOLD FOR AN INTERNAL COMBUSTION ENGINE

BACKGROUND OF THE INVENTION

The present invention relates to a plastic air intake manifold for an internal combustion engine.

Rowbotham, United Kingdom Patent Application No. GB 1,601,817 (=German Patent No. DE 2,822,409) discloses an air intake manifold for an internal combustion engine which is made in one piece from synthetic resin material. This manifold shows that it is possible to design both the attaching flange and the individual duct sections which emanate from a common intake tube in one piece and manufacture it in a single operation. The process of manufacturing such an air intake manifold is quite difficult, however, so that until now it has been necessary to avoid particularly complex shapes.

Schleiermacher et al., European Patent No. EP 251,159 teaches an arrangement in which the leakage gases or blow-by gases which collect in the crankcase of an internal combustion engine are returned to the air intake manifolds of the cylinders. These blow-by gases result from the fact that the piston rings cannot produce a one-hundred-percent seal between cylinder and crankcase. Consequently the blow-by gases, which consist partly of unburned air-fuel mixture and partly of combustion gases, enter the crankcase and must be returned from the crankcase to the air intake manifold. This recycling has the generally known positive additional effect that small amounts of oil vapor accompany it. This oil lubricates the valve seats, so that it is desirable to feed the blow-by gases not just to the intake manifold duct of only one cylinder, but to distribute it as uniformly as possible to all cylinders. To this end, European Patent No. EP 251,159 discloses the use of a separate tube which is inserted into the air intake canister and has openings which are so arranged that each cylinder is supplied with a specific amount of blow-by gases. This additional tube, however, has to be inserted into the air intake canister and is fastened to the canister with suitable fastening means.

Another variant which is described in the above-described state of the art contemplates integrating the return duct directly into the cylinder head. This, however, requires an additional and very complicated machining of the cylinder head. Such integration signifies that the cylinder head must have a bore along its long axis, and this bore is very difficult to make due to its length and its small diameter.

Also known from Ishikawa, Japanese Published Patent Application No. JP 2-37104, is an apparatus for feeding blow-by gas to an air intake manifold, in which two airways communicating with one another are provided in the center between two air intake manifolds situated side by side, one end of each airway being next to the inner circumference of an air intake manifold and the other end leading into an open chamber into which the blow-by gases are introduced. In this arrangement, however, there is a disadvantage that a relatively large number of connections are necessary for recycling the blow-by gases, which thus make the system more liable to trouble.

SUMMARY OF THE INVENTION

It is the object of the invention to provide an air intake manifold for an internal combustion engine which is configured to introduce a gas, such as blow-by gases, uniformly to the individual intake ducts of the engine.

It is also an object of the invention to provide an air intake manifold which can be manufactured in a simple manner without additional structural elements.

These and other objects of the invention are achieved in accordance with the present invention by providing an air intake manifold for an internal combustion engine comprising a mounting flange for fastening the manifold to a cylinder head, a plurality of air intake ducts emanating from a common inlet and opening through the mounting flange, a plurality of channels in the mounting flange communicating with the intake ducts, wherein each channel disposed between two adjacent intake ducts connects the two adjacent ducts, and connecting means associated with the channels for introducing a gas into the channels.

In accordance with a further aspect of the invention, the objects are also achieved by providing an air intake manifold for an internal combustion engine comprising a mounting flange for fastening the manifold to a cylinder head, a plurality of air intake ducts emanating from a common inlet and opening through the mounting flange, a longitudinal passageway in the mounting flange extending beside each of the intake ducts, a plurality of transverse bores each communicating with the passageway and opening into a respective one of the intake ducts, and connecting means for introducing a gas into the passageway.

An important aspect of the invention is to configure the feed of air or gas in such a manner that the air and gas are introduced into the air intake tract as closely as possible to the valves without machining the cylinder head or engine block. This also prevents any condensed moisture that might enter from icing up the air intake tract.

Moreover, the invention achieves the result that even on the air intake manifold, no means are needed that would unnecessarily complicate or increase the manufacturing cost of the air intake manifold.

In accordance with an alternative embodiment of the invention, a longitudinal bore or passageway is arranged in the mounting flange of the air intake manifold from which transverse bores branch off and open into the individual intake ducts adjacent the face of the mounting flange attached to the cylinder head. Such a longitudinal passageway is substantially easier to make in an air intake manifold than it is in a cylinder head. Such a longitudinal passageway also can help to avoid having excess material at particular points, which is usually accomplished by ribbing or by creating recesses. To that extent such a bore or passageway can also contribute to the structural soundness of the air intake manifold.

In accordance with an advantageous embodiment of the invention provision is made so that the channels through which the blow-by gases enter the intake can be formed in the immediate vicinity of the mounting surface on the cylinder head, e.g. in the face of the mounting flange which is attached to the cylinder head. As a matter of design, these openings can be constructed in the form of grooves which are made on the mounting surface of the air intake manifold. These grooves can then be positively closed off by the mounting surface of the cylinder head when the manifold is attached. From a production point of view, it is very easy to produce these grooves, especially in a manifold made by injection molding of thermoplastic synthetic resin material where machining operations can be avoided by forming the grooves during molding.

If the air intake manifold is provided with a longitudinal bore or passageway according to the aforementioned alternative preferred embodiment, then in accordance with a further preferred embodiment the transverse bores can have different diameters in order to achieve specific throttling cross-sections so as to distribute the blow-by gases uniformly to the individual cylinders or individual valves, as the case may be. This can be achieved, for example, by providing the transverse bore reached first by the incoming blow-by gas with the smallest diameter and successively increasing the diameter of each succeeding transverse bore in the direction of flow along the passageway.

In an internal combustion engine having two intake valves per cylinder, two intake ducts per cylinder are also required. According to a further preferred embodiment of the invention, the intake ducts situated next to one another can be provided with a single connection for the blow-by gases, this connection opening into a groove extending between the two duct sections.

Another application of the long passageway in the air intake manifold is to feed clean air taken from the clean air stream from the air filter through this bore to the valve seats of the fuel injector valves. These fuel injector valves, which are fastened in valve bores directly above and close to the respective intake ducts, require additional air when the engine is idling, which facilitates better mixing of the injected fuel. This additional air can advantageously be supplied through the longitudinal bore and the transverse bores which branch off from the longitudinal bore to the individual valves.

BRIEF DESCRIPTION OF THE DRAWINGS

The invention will be described in further detail with reference to illustrative preferred embodiments shown in the accompanying drawings, in which.

DETAILED DESCRIPTION OF PREFERRED EMBODIMENTS

Figure 1A:
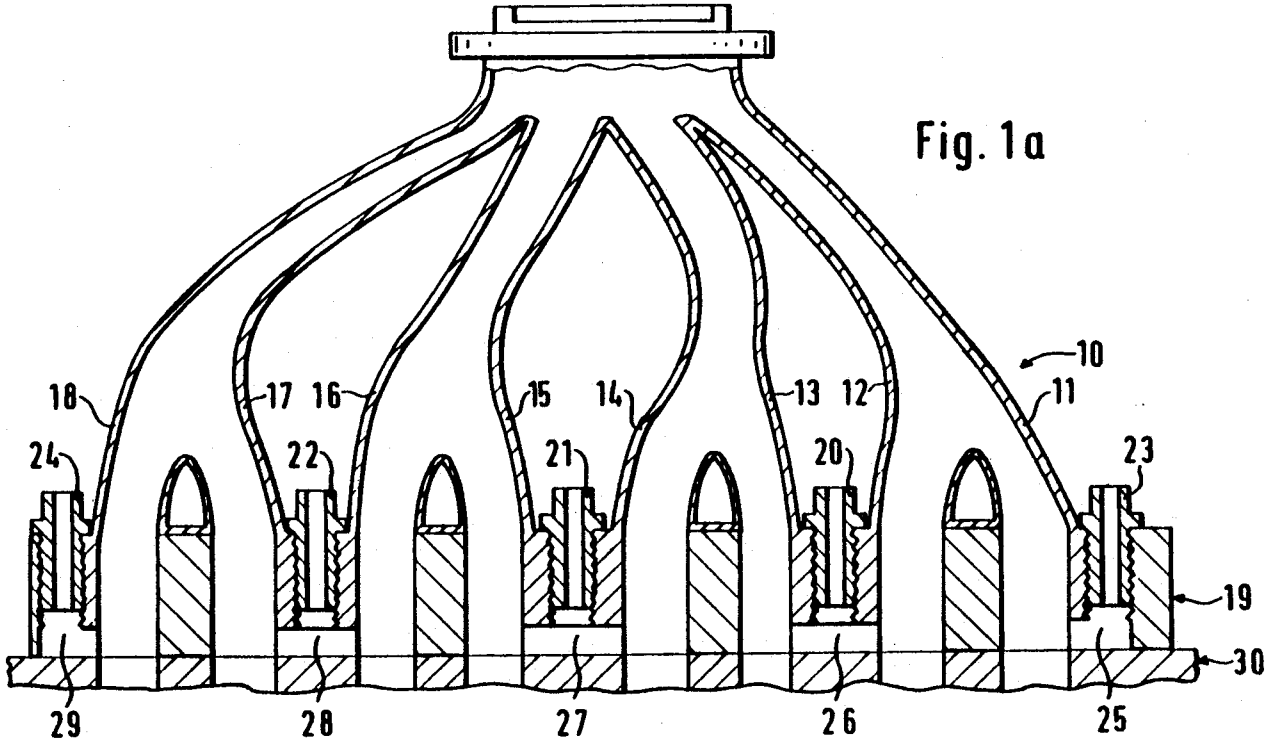
FIG. 1*a* is a sectional view and FIG. 1*b* is a plan view of an air intake manifold according to the present invention.

FIG. 1 shows the front part of an air intake manifold 10 for an internal combustion engine with the individual intake ducts 11–18. The air intake manifold 10 is designed for an internal combustion engine having four cylinders and two intake valves per cylinder. The air intake manifold 10 therefore is divided into eight individual intake ducts 11–18. As can be seen from FIG. 1*a*, the ducts are connected at their front ends by a mounting flange 19. This mounting flange is fastened by means of bolts or the like to a cylinder head 30, shown here only in part. Between adjacent pairs of intake ducts for the respective cylinders, there are connecting bores in which connecting means 20, 21, 22, are fastened. Furthermore, outside of the outer intake ducts 11 and 18 there are likewise two bores in which two additional connecting means 23 and 24, are fastened. Each connecting bore opens into a groove 25, 26, 27, 28, 29. Each of grooves 26, 27 and 28 extends between two adjacent intake ducts and thus forms a channel from the respective connecting means to the associated air intake openings.

The blow-by gases which collect in the crankcase and are to be returned into the air intake tract pass through a duct (not shown) to the connecting means 20–24. This duct can consist, for example, of a plurality of hoses which are attached to the connecting means. The surface of the cylinder head 30 facing the air intake manifold forms a natural boundary for the grooves 25–29. The outer intake ducts 11 and 18 are each supplied individually with the blow-by gases through connecting means 23 and 24, so that it is assured that the outer valves will have the same amount of blow-by gases available as do the inwardly located valves.

Figure 1B:
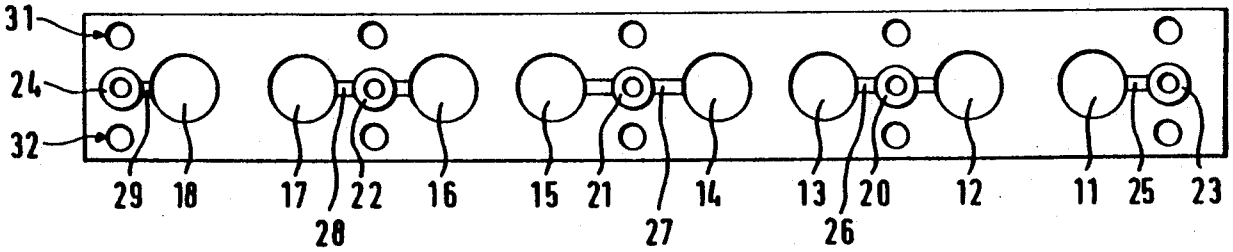

FIG. 1*b* shows a plan view of the mounting flange. In this plan view the openings of the intake ducts 11–18 can be seen, as well as the grooves 25–29 and the connecting means 20–24. The mounting flange 19 is furthermore provided with two rows of holes 31, 32, for fastening the flange to the cylinder head. for example, by means of bolts. The connecting means 20–24 are inserted into the corresponding bores and fastened in this bore for example by means of threads or snap fasteners. Of course, it is also possible to configure the mounting flange 19 in such a way that the connecting means are superfluous, i.e., to provide the flange itself with nipples to which the hoses can be attached.

Figure 2:
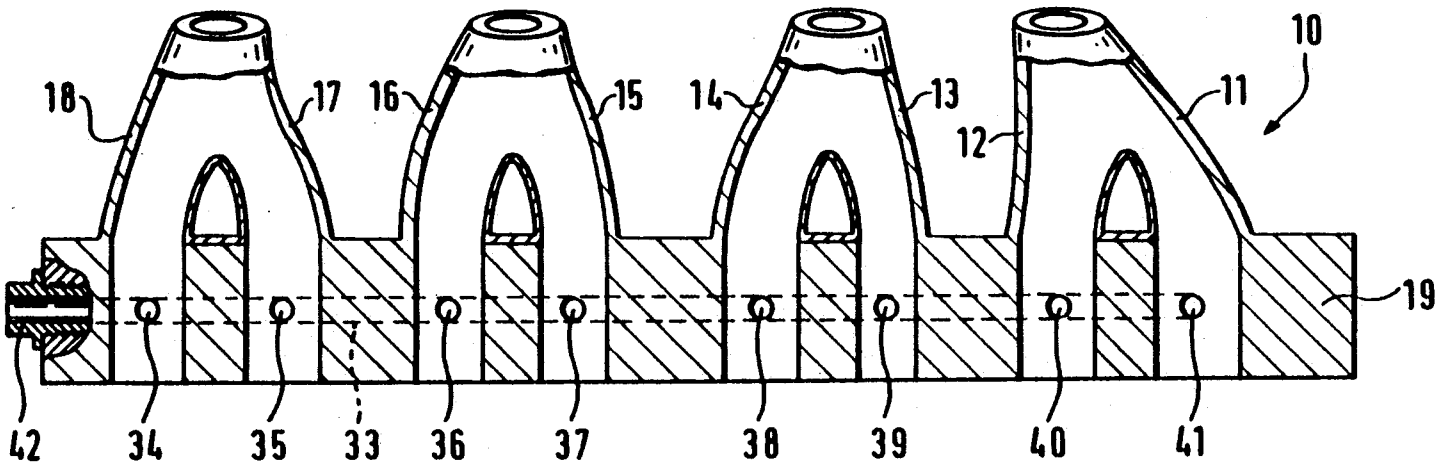
FIG. 2 is a sectional view through another variant of the air intake manifold according to the present invention.

FIG. 2 shows a variant of an air intake manifold 10 according to the invention. This manifold also comprises a mounting flange 19 in which there is a longitudinal bore or passageway 33. Transverse bores 34–41 branch out from this longitudinal bore 33 and each lead to one of the intake ducts 11–18. The longitudinal bore 33 is open at one end where it is provided with a connecting means 42 onto which a hose carrying the blow-by gases is attached. In the illustrated embodiment, the longitudinal bore 33 is situated approximately in the center of the mounting flange. Instead of such a bore or passageway, it is also possible to provide a longitudinal groove or channel directly on the side of the mounting flange 19 facing the cylinder head 30. Transverse grooves, which extend all the way to the intake ducts, branch off from this longitudinal groove. Such grooves are simple to produce in a synthetic resin part, since no slides are needed for this purpose in an injection-molding die.

Figure 3:
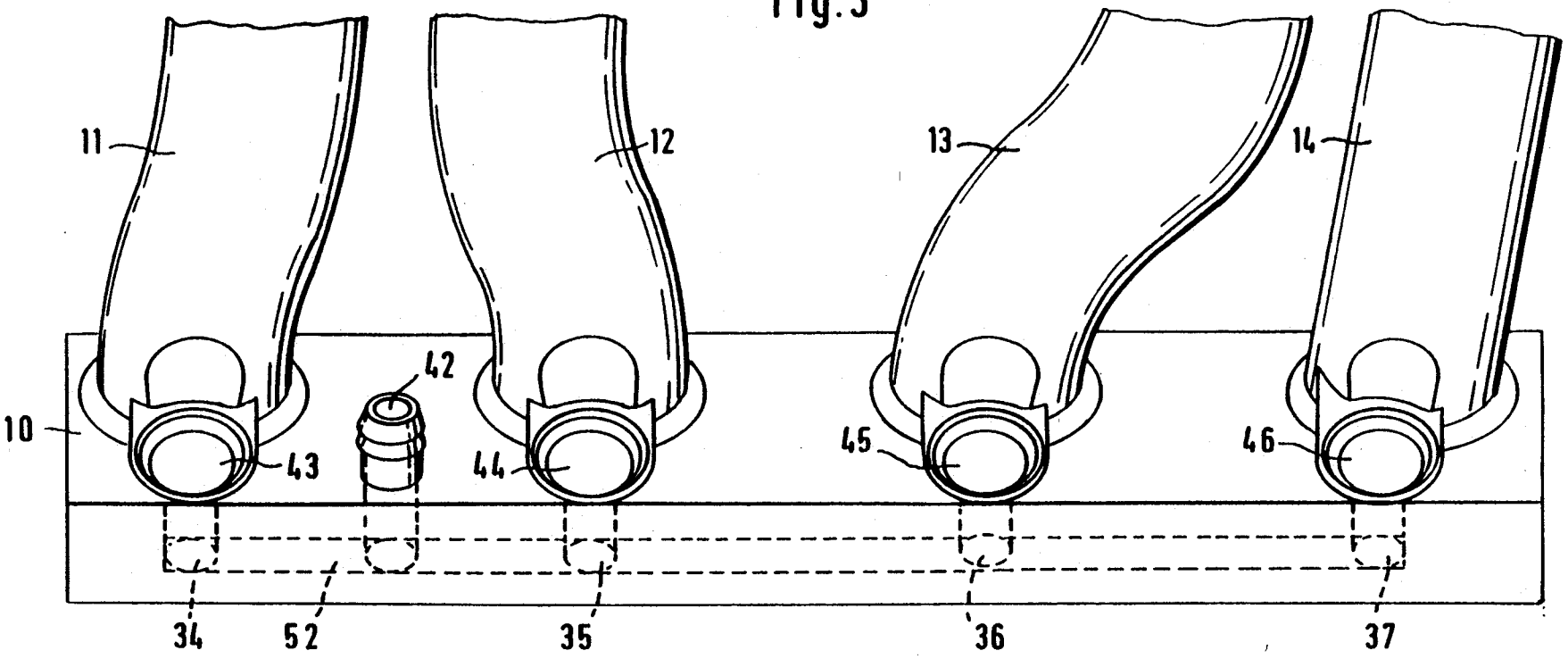
FIG. 3 is a plan view of an air intake manifold according to the invention provided with fuel injector valve seats.

The air intake manifold 10 shown in FIG. 3 comprises intake ducts 11, 12, 13 and 14. Valve seats 43, 44, 45, 46 for fuel injection valves are disposed above the intake ducts. When the engine is idling, these fuel injection valves need to be flooded with clean air which is introduced into the fuel through bores on the valves and produces a better turbulent mixing of the fuel. A longitudinal bore 33 is shown in the air intake manifold 10. This bore is provided with a connecting means 42. The transverse bores 34, 35, 36, 37 which branch off from the longitudinal bore each extend to the inside wall of one of the valve seats 43 to 46. Alternatively, the longitudinal bore may be replaced by a longitudinal groove 52, as shown in FIG. 4.

Figure 4:
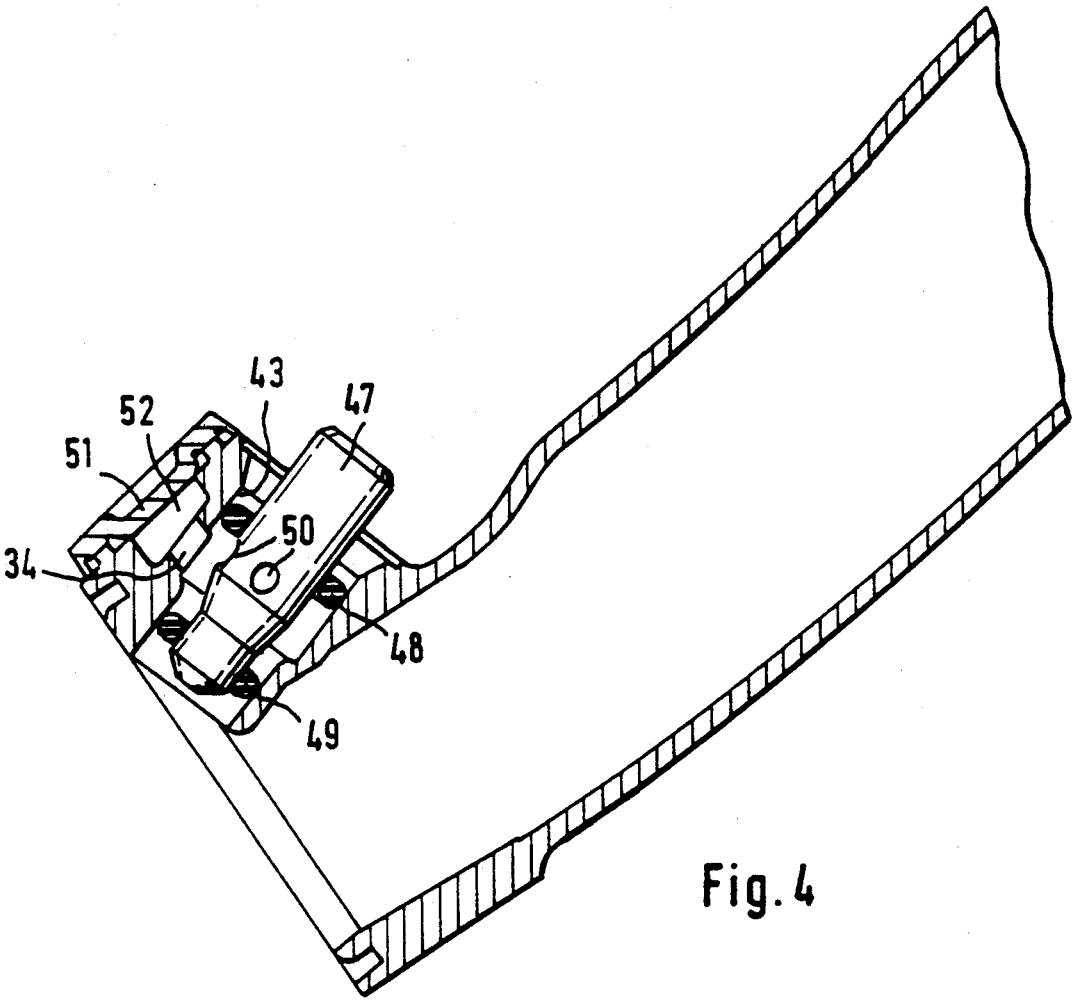
FIG. 4 is a sectional view through the air intake manifold of FIG. 3.

In the sectional view shown in FIG. 4, a fuel injection valve 47 is illustrated in the valve seat 43. Valve 47 is held in valve seat 43 by O-rings 48 and 49 and is provided on its circumference with air inlet openings 50.

As can be seen in the drawing, the longitudinal groove 52 is closed off by a cover 51. In the illustrated embodiment, cover 51 is secured over groove 52 by welding the margins of the cover to the edges of the mounting flange at the sides of the groove. Other suitable fastening means, such as bolts, could be used in place of welding. When the engine is idling, additional air is supplied from the clean air side of the air cleaner to groove 52 and flows through groove 52, transverse bore 34, air inlets 50 and injector valve 47. Of course, it is also possible to use a longitudinal bore as shown in FIG. 2 in place of groove 52.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An air intake manifold for an internal combustion engine comprising a mounting flange for fastening said manifold to a cylinder head, a plurality of air intake ducts emanating from a common inlet and opening through said mounting flange, a longitudinal passageway in said mounting flange extending beside each of said intake ducts, a plurality of transverse bores each communicating with said passageway and opening into a respective one of said intake ducts, and connecting means for introducing a gas into said passageway, wherein each of said transverse bores opens through an inside wall of a fuel injection valve seat, and air is conveyed from a clean air side of an air filter through each of said transverse bores to a fuel injector valve disposed in said valve seat.

2. An air intake manifold according to claim 1, wherein said manifold is formed of a thermoplastic synthetic resin material.

3. An air intake manifold according to claim 1, wherein said connecting means is in communication with a crankcase of the internal combustion engine and serves to introduce blow-by gases from said crankcase into the intake ducts.

4. An air intake manifold according to claim 1, wherein each of said transverse bores opens into a respective intake duct adjacent a face of said mounting flange which is fastened to said cylinder head.

5. An air intake manifold according to claim 1, wherein successive transverse bores in the direction of flow along said passageway have successively larger cross-sections to provide uniform gas flow through the transverse bores.

6. An air intake manifold according to claim 1, wherein said passageway is formed by an open-sided longitudinal groove in said mounting flange and a cover disposed over the open side of said groove.

* * * * *